US010117468B1

(12) United States Patent
Clarke

(10) Patent No.: US 10,117,468 B1
(45) Date of Patent: Nov. 6, 2018

(54) BRASSIERE CONFIGURED FOR OPERATION BY WEARERS OF LIMITED DEXTERITY, A METHOD OF USE, AND/OR A METHOD OF MANUFACTURING THEREOF

(71) Applicant: Darla A Clarke, Noble, OK (US)

(72) Inventor: Darla A Clarke, Noble, OK (US)

( * ) Notice: Subject to any disclaimer, the term of this patent is extended or adjusted under 35 U.S.C. 154(b) by 0 days.

(21) Appl. No.: 15/836,483

(22) Filed: Dec. 8, 2017

(51) Int. Cl.
*A41C 3/00* (2006.01)

(52) U.S. Cl.
CPC ..... *A41C 3/005* (2013.01); *A41C 3/0028* (2013.01)

(58) Field of Classification Search
CPC ..... A41C 3/005; A41C 3/0028
USPC ..... 450/86
See application file for complete search history.

(56) References Cited

U.S. PATENT DOCUMENTS 2,455,036 A * 11/1948 Boylan ..... A41F 1/006 450/86
2,870,768 A * 1/1959 Robinson ..... A41F 15/00 450/113
3,623,487 A * 11/1971 Chiu ..... A41C 3/0021 2/323
3,827,441 A * 8/1974 Rudolph ..... A41C 3/0007 450/1
3,935,865 A * 2/1976 Newmar ..... A41C 3/0078 450/64
4,300,568 A * 11/1981 Blanckmeister ..... A41F 1/006 450/85
5,024,628 A * 6/1991 Sanchez ..... A41C 3/0028 2/104
6,253,424 B1 7/2001 Rainville-Lonn
6,256,424 B1 * 7/2001 Murakami ..... G06T 5/008 358/520
6,733,362 B2 * 5/2004 Plew ..... A41C 3/00 2/67
8,075,369 B2 * 12/2011 Hendrickson ..... A41C 3/0028 450/86
8,439,722 B2 * 5/2013 Buriak ..... A41C 3/02 450/59
2003/0186619 A1 * 10/2003 Falla ..... A41F 15/007 450/86
2008/0113587 A1 * 5/2008 Richardson ..... A41C 3/0021 450/58
2009/0126084 A1 * 5/2009 Fenske ..... A41C 3/005 2/338
2009/0258572 A1 * 10/2009 Chayo ..... A41C 3/0028 450/39
2010/0297915 A1 * 11/2010 Otto ..... A41C 3/00 450/86
2011/0275278 A1 * 11/2011 Shashy ..... A41C 3/0057 450/86
2012/0021669 A1 * 1/2012 Johnstone ..... A41C 3/0028 450/58
2013/0065483 A1 * 3/2013 Liguori ..... A41F 1/006 450/1

* cited by examiner

*Primary Examiner* — Gloria Hale
(74) *Attorney, Agent, or Firm* — Garcia-Zamor IP Law; Ruy M. Garcia-Zamor

(57) ABSTRACT

A brassiere configured for operation by wearers of limited dexterity, such as those with limited use of fingers, hands, wrists, arms, and/or shoulders. The brassiere may include a shoulder support element which may provide support to the wearer's torso and breasts without requiring strain to be placed on both hands, wrists, arms, and shoulders when fastening the brassiere.

18 Claims, 5 Drawing Sheets

BRASSIERE CONFIGURED FOR OPERATION BY WEARERS OF LIMITED DEXTERITY, A METHOD OF USE, AND/OR A METHOD OF MANUFACTURING THEREOF

BACKGROUND

The present invention is generally directed to articles of clothing and, more specifically, feminine undergarments, such as brassieres. More specifically still, the invention is directed toward brassieres which may be fastened and unfastened by a woman with limited dexterity, such as those with limited use of one or more of her arms and/or hands.

Brassieres are typically worn over the upper torso, lifting the breasts into a preferred position while concealing portions of the breasts. The position may be preferred for numerous reasons, including but not limited to: alleviating strain on the back, preventing excess movement of the breasts, and/or creating a desired silhouette or shape of the bosom.

Many known brassieres are difficult to put on for women of limited dexterity. Existing brassieres tend to provide even support to two breast cups by including two straps that go over each of a woman's shoulders. Such a configuration requires a woman to use both hands to pull opposing rear sides of the brassiere close together for fastening, either in the front or back side of her torso. Some such configurations may also require a woman to insert both of her arms through the brassiere straps, either before or after fastening. These movements can be painful or impossible for women with injured shoulders, collar bones, ribs, arms, wrists, hands, or women suffering from other upper body injuries or infirmities. For some women suffering from shoulder or arm injuries, the pressure put on an injured arm and/or shoulder by brassiere straps can cause discomfort and pain even without additional movement.

Other known brassieres fasten between the two breast cups, which typically requires a woman to use both arms to pull both cups inward for fastening. Furthermore, front fastening brassieres fail to provide the silhouette and shaping preferred by many brassiere wearers.

It may be advantageous to provide a brassiere that is at least one of: easily put on during dressing; may be readily put on by a woman using a single arm; that is adjustable so as to provide a proper fit for multiple body types while still being adapted for dressing with a single arm; that is aesthetically pleasing; and/or that is efficient to manufacture.

SUMMARY

Briefly speaking, one embodiment of the present invention is directed to a brassiere configured for dressing using a single arm by a person which may include a cup support panel having first and second lateral ends and first and second breast cups thereon. The brassiere may also include a back panel having a panel end, attached to the second lateral end of the cup support panel, and a free end, which may be detachably securable to first lateral end of the cup support panel. Through such a configuration, the first lateral end of the cup support panel and the free end of the back panel may be positioned along the side of the person (the area forward of the shoulder blade) when the person is fully dressed in the brassiere. The brassiere may further include a shoulder support configurable into a Y-shape, having first and second splayed arms and a transverse arm. The transverse arm may be connected to only one of the first and second breast cups, and the first and second splayed arms may be connected to the back panel.

In a separate embodiment, the back panel may include a pull strap positioned on the free end of the back panel. The free end of the back panel may be secured to the cup support panel via hook-and-loop material. The entire length of the pull strap may be detachably connected along an underside of the first breast cup when the brassiere is worn, such that the entire length of the pull strap lays directly over the cup support panel. In some other embodiments, the back panel may further include a side panel that forms the free end.

In a separate embodiment, the shoulder support may be formed of a first elongated member and a second elongated member. The first elongated member may form the transverse arm, and may have a junction at an end opposite from the cup support panel. The second support member may form the first and second splayed arms, with the junction defining which portions of the second elongate member form the first and second splayed arms, respectively. The position of the junction on the second support member may be adjustable. In some other preferred embodiments, the junction may be positionally fixed on the second elongated member and not adjustable on the first and second splayed arms. In some embodiments, the first and second splayed arms may be connected to the back panel at locations that are aligned behind the first and second cups when the brassiere is worn. In other embodiments, the locations on the back panel to which the first and second splayed arms connect may be adjustable, and they may be either at any point on the back panel or to the back panel at two of a plurality of locations.

In a separate embodiment, the length of the second elongated member and/or the length of the first elongated member may be adjustable. In some other embodiments, the transverse arm may be detachably connected to either one of the first and second breast cups. In some other embodiments, the back panel is not adjustable in length.

In another separate aspect, the cup support panel may further include channeling along the first and second breast cups, which may provide contour and shaping to the brassiere without the use of underwire. In addition, in some embodiments the cup support panels may include boning, to provide greater lift and support. Specifically, it is preferred that boning is only present in the lateral end of the cup support panel proximate to the breast cup which is not attached to the shoulder support. In the preferred embodiment, boning is present in the second lateral end of the cup support panel so that it may provide additional support to the second breast cup, as the second breast cup is preferably not connected to the shoulder support.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENT

Figure 5:
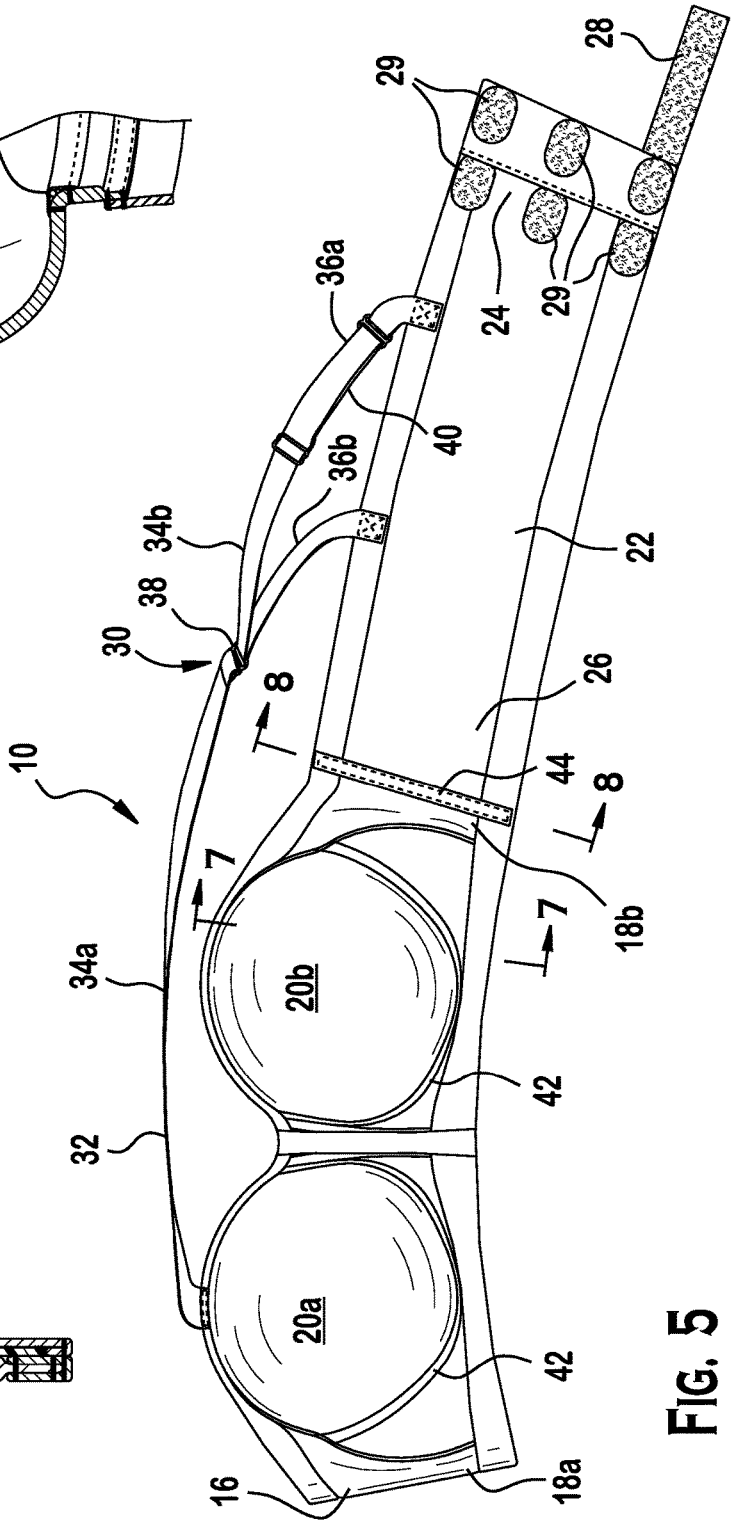
FIG. 5 is a rear side elevation view of the brassiere 10 placed flat with its inner side facing upward. The figure shows the lateral layout of the preferred embodiment of the brassiere 10, showing the first lateral end 18*a* of the cup support panel 16 being proximate to the first breast cup 20*a*, the second breast cup 20*b* being proximate to the second lateral end 18*b* of the cup support panel 16, the panel end 16 of the back panel 22 being connected to the second lateral end 18*b*, and the free end 24 of the back panel 22 ending in a pull strap 28 and including hook-and-loop material 29.

Certain terminology is used in the following description for convenience only and is not limiting. The words "right," "left," "top," and "bottom" designate directions in the drawings to which reference is made. The words "outer" and "inner" refer to directions away from and toward, respectively, the geometric center of the person's body when the brassiere is worn. "Lateral ends" refers to opposite far left and right ends of the brassiere when it is not in use, such as the brassiere as seen in FIG. 5. Additionally, the words "a" and "one" are defined as including one or more of the referenced item unless specifically stated otherwise. The terminology includes the words above specifically mentioned, derivatives thereof, and words of similar import.

Referring to FIGS. 1-8 wherein like numeral indicate like elements throughout, there are shown preferred embodiments of a brassiere 10, with a brassiere, generally, being a form-fitting undergarment designed to support the breasts. Brassieres are typically worn over a portion of the torso, wrapping around a portion of the torso and covering at least a portion of the breasts.

Most generally speaking, this invention is directed toward a brassiere 10 configured to be put on and worn by a person, preferably a woman, using a single arm.

Figure 1:
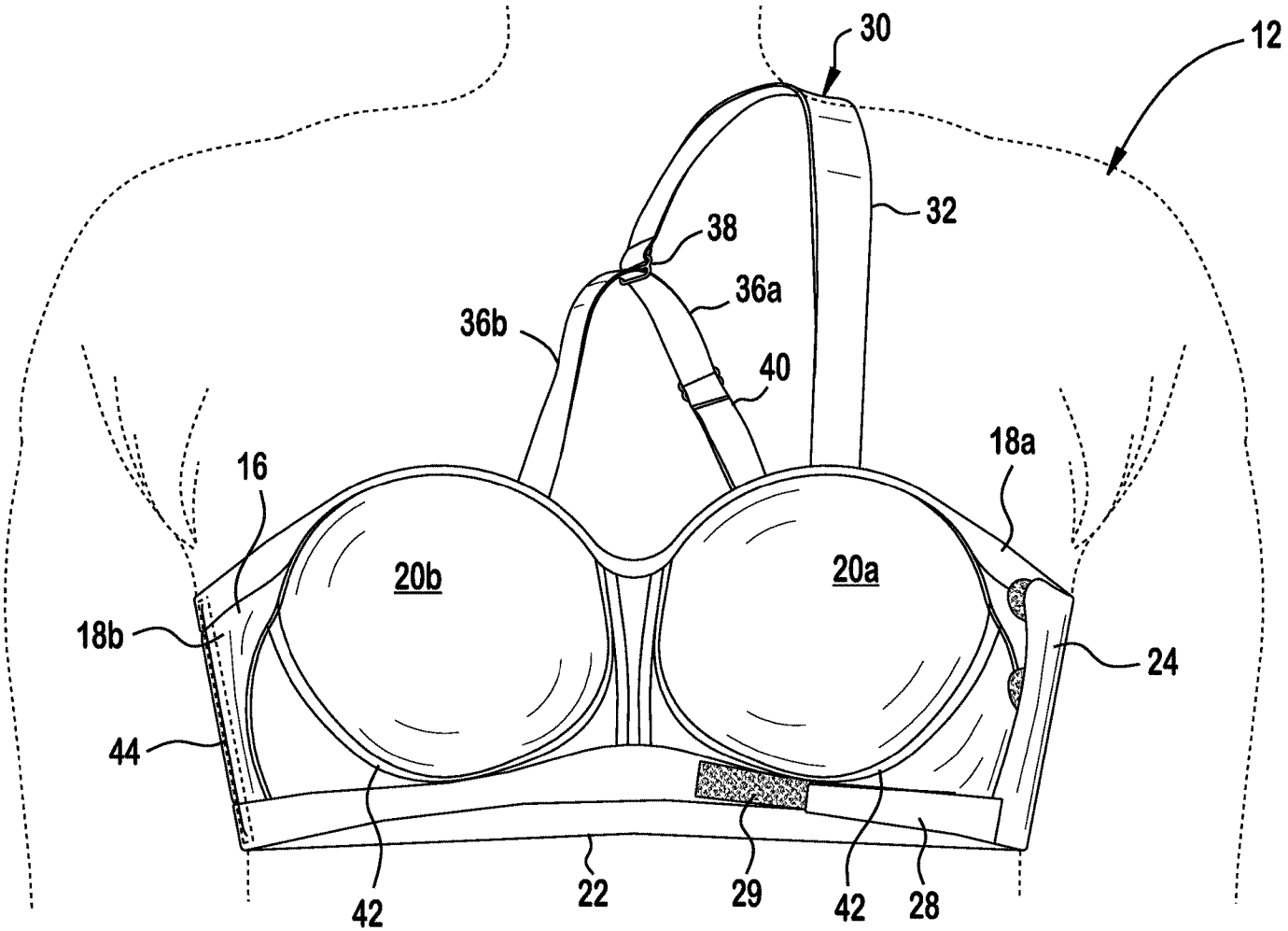
FIG. 1 is a front side elevational view of a first preferred embodiment of the brassiere 10 worn by a person 12. The view best demonstrates the preferred placement of the first breast cup 20*a* and second breast cup 20*b* in the cup support panel 16, particularly in relation to the first lateral end 18*a* and second lateral end 18*b* of the cup support panel 16. The connection of the transverse arm 32 of the shoulder support 30 to the first breast cup 20*a* can also be seen. The figure also includes an adjustment mechanism 40 which may be included on the shoulder support 30 to allow the brassiere 10 to provide customized support to a person 12.
Figure 7:
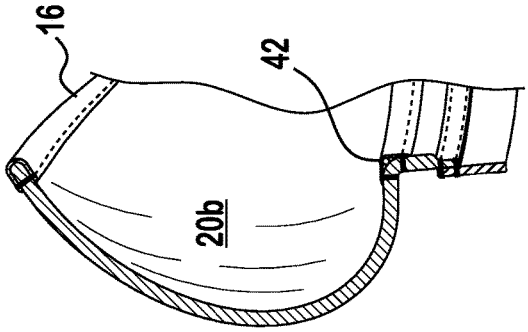
FIG. 7 is a cross sectional view of the brassiere 10 of FIG. 5 as taken along the lines 7-7 of FIG. 5 which demonstrates that the three dimensional shape of the second breast cup 20*b*, including the channeling 42 positioned along the underside of the cup. The first breast cup 20*a* preferably has a similar three dimensional shape. Those of ordinary skill in the art will appreciate from this disclosure that the breast cups may be provided in any three dimensional shape without exceeding the scope of this disclosure.
Figure 8:
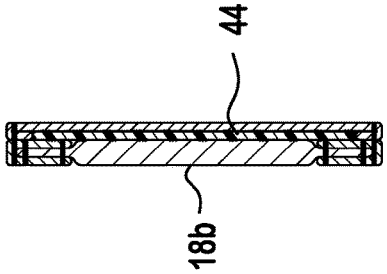
FIG. 8 is a cross sectional view of the brassiere 10 of FIG. 5 as taken along the lines 8-8 of FIG. 5 which demonstrates the positioning and shape of the boning 44 which is preferably positioned in the lateral end of the cup support panel proximate to the breast cup which is not attached to the shoulder support. In the preferred embodiment, boning 44 is present in the second lateral end 18*b* of the cup support panel 16 so that it may provide additional support to the second breast cup 20*b*, as the second breast cup 20*b* is preferably not connected to the shoulder support 30. Those of ordinary skill in the art will appreciate from this disclosure that boning 44 may be provided in either or both lateral ends of the cup support panel 16, alongside either or both of the first and second breast cups 20*a-b*, or on the cup support panel 16 between the first and second breast cups 20*a-b* without exceeding the scope of this disclosure.

Referring to FIGS. 1 and 7-8, the brassiere 10 preferably includes two major panels, a cup support panel 16 and back panel 22, which are positioned on opposite sides of the person 12 when the brassiere 10 is worn. The cup support panel 16 preferably has a first lateral end 18*a* and second lateral end 18*b*, and has a first breast cup 20*a* and second breast cup 20*b* positioned thereon. The first and second breast cups 20*a-b* are preferably roughly circular in shape, with a roughly convex surface. Those of ordinary skill in the art will appreciate from this disclosure that the first and second breast cups 20*a-b* may be provided in any suitable shape without exceeding the scope of this disclosure.

In some preferred embodiments, the front support panel 16 may also include channeling 42 positioned along the some or all of the outer portions of either first or second cup, 20*a* or 20*b*, which may help provide greater support and contour to the breasts of the person 12 wearing the brassiere 10. Channeling 42 may be included to provide a preferred shape to the first and second breast cups 20*a-b*. It is preferred that the channeling 42 be formed of soft and flexible material such as cotton, synthetic material, or some blend thereof, or of some lightweight foam. However those of ordinary skill in the art will appreciate from this disclosure that any suitable material may be used without exceeding the scope of the present invention. It is further preferred that the channeling 42 be free of underwire or other rigid inserts.

In other preferred embodiments, boning 44 may be included in the lateral end of the cup support panel proximate to the breast cup which is not attached to the shoulder support. In the preferred embodiment, boning 44 is present in the second lateral end 18*b* of the cup support panel 16. Boning 44 may provide additional support to the second breast cup 20*b*, which is preferably not connected to the shoulder support 30. Those of ordinary skill in the art will appreciate from this disclosure that boning 44 may be provided in either or both lateral ends of the cup support panel 16, alongside either or both of the first and second breast cups 20*a-b*, or on the cup support panel 16 between the first and second breast cups 20*a-b*, without exceeding the scope of this disclosure. It is preferred that the boning 44 be formed of rigid material or semi-rigid materials such as whale bone, metal, molded plastic, hard rubber, or any other suitable material.

Referring to FIGS. 2-5, the brassiere 10 preferably includes a back panel 22 having two lateral ends. The first may be called the panel end 26 and the second may be called the free end 24. The panel end 26 is preferably connected to the second lateral end 18*b* of the cup support panel 16. As it is preferred that the panel end 26 is attached to the second lateral end 18*b*, it is preferred that the panel end is either adjacent to (or next to) or overlapping the second lateral end 18*b*. The free end 24 of the back panel 22 is preferably detachably securable to first lateral end 18*a* of the cup support panel 16. In some embodiments, it is preferred that the back panel 22 forms a side panel that forms the free end 24. That is to say, in some preferred embodiments, the free end 24 may be a separate panel that has been affixed to the back panel 22. Those of ordinary skill in the art will appreciated from this disclosure that the panel end 26 may be affixed to the first lateral end 18*a* and the free end 24 may be detachably affixed to the second lateral end 18*b* without exceeding the scope of this disclosure.

In some embodiments, it is preferred that the back panel 22 is not adjustable in length. Such a configuration can help keep the brassiere 10 from requiring too much dexterity from the user.

It is preferred that the back panel 22 and the cup support panel 16 be configured so that when the person 12 is fully dressed in the brassiere 10, the first lateral end 18*a* of the cup support panel 16 and the free end 24 of the back panel 22 connect along the side of the person 12. The side of the person includes any part of the torso forward of either the first shoulder blade 14*a* or second shoulder blade 14*b* of the person 12. Preferably, this is typically a portion of the torso under a person's arm and prior to the breasts.

It is further preferred that free end 24 of the back panel 22 be detachably secured to the first lateral end 18*a* of the cup support panel 16 via hook-and-loop material 29. The back panel 22 may further comprise a pull strap 28, which may extend from the free end 24 of the back panel 22. Preferably this pull strap 28 may extend from the bottom corner of the free end 24, and may be formed of a narrow rectangular or ovular strip preferably between ½ of an inch to 4 inches wide and 2 inches to 8 inches long, to best provide assistance to the wearer to grab to pull the back panel 22 across her back. However, those of ordinary skill in the art will appreciate from this disclosure that the pull strap 28 may be any suitable size or shape without exceeding the scope of this invention. The pull strap 28 is also preferably detachably connected along the underside of the first breast cup 20*a* when the brassiere 10 is being worn, preferably using hook-and-loop material 29. This configuration preferably allows the entire length of the pull strap 28 to lay directly over the cup support panel 16. This ensures that the pull strap 28 may be fully hidden from view when fastened to the cup support panel 16, without excess length of the pull strap 28 hanging therefrom. However, those of ordinary skill in the art will appreciate from this disclosure that the hook-and-loop material 29 may be replaced with any suitable means for securing, such as hook-and-eye fasteners, buttons, snaps, adhesive, or any other connective means may be used without exceeding the scope of this disclosure.

Figure 2:
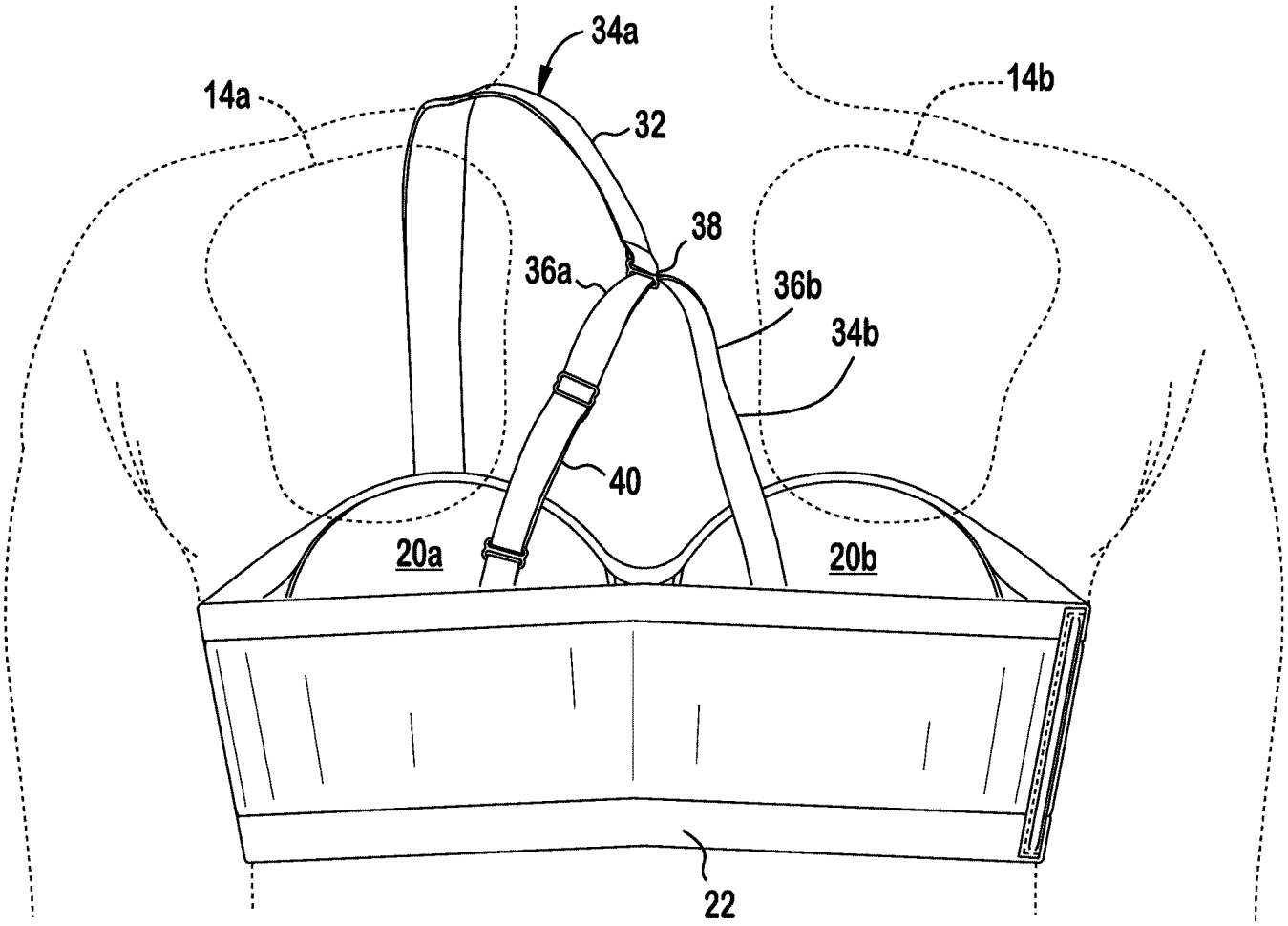
FIG. 2 is rear side elevational view of the brassiere 10 of FIG. 1, showing the back panel 22, and the preferred position of the first splayed arm 36*a* and second splayed arm 36*b* on the back panel 22. Specifically, it can be seen that the first splayed arm 36*a* and second splayed arm 36*b* are preferably positioned roughly opposite of the first breast cup 20*a* and second breast cup 20*b* when the brassiere 10 is worn by a person 12. The figure also demonstrates that the shoulder support 30 may be formed of two elongated members, with the first elongated member 34*a* defining the transverse arm 32 connected to the first breast cup 20*a* on side and defining a junction 38 on the other. The junction 38 may meet the second elongated member 34*b*, with the placement of the junction 38 on the second elongated member 34*b* defining the first splayed arm 36*a* and second splayed arm 36*b*. The drawing also shows the first shoulder blade 14*a* and second shoulder blade 14*b* of the person 12, to illustrate which portion of the person 12 may be considered his or her side.
Figure 4:
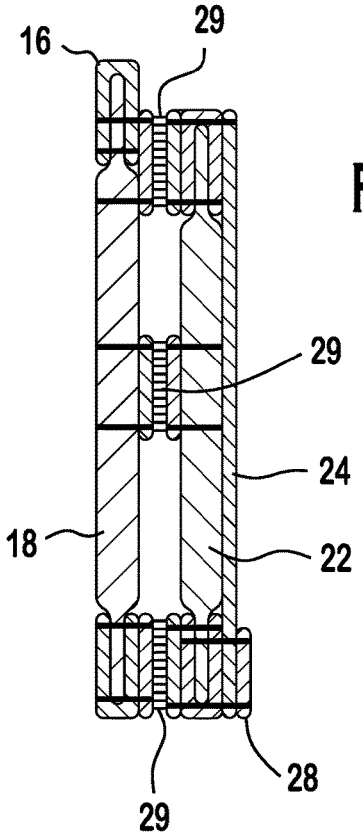
FIG. 4 is a cross sectional view of the brassiere 10 of FIG. 3 as taken along the lines 4-4 of FIG. 3 which demonstrates how the hook-and-loop material 29 may detachably connect the free end 24 of the back panel 22 and the pull strap 28 to the cup support panel 16.
Figure 3:
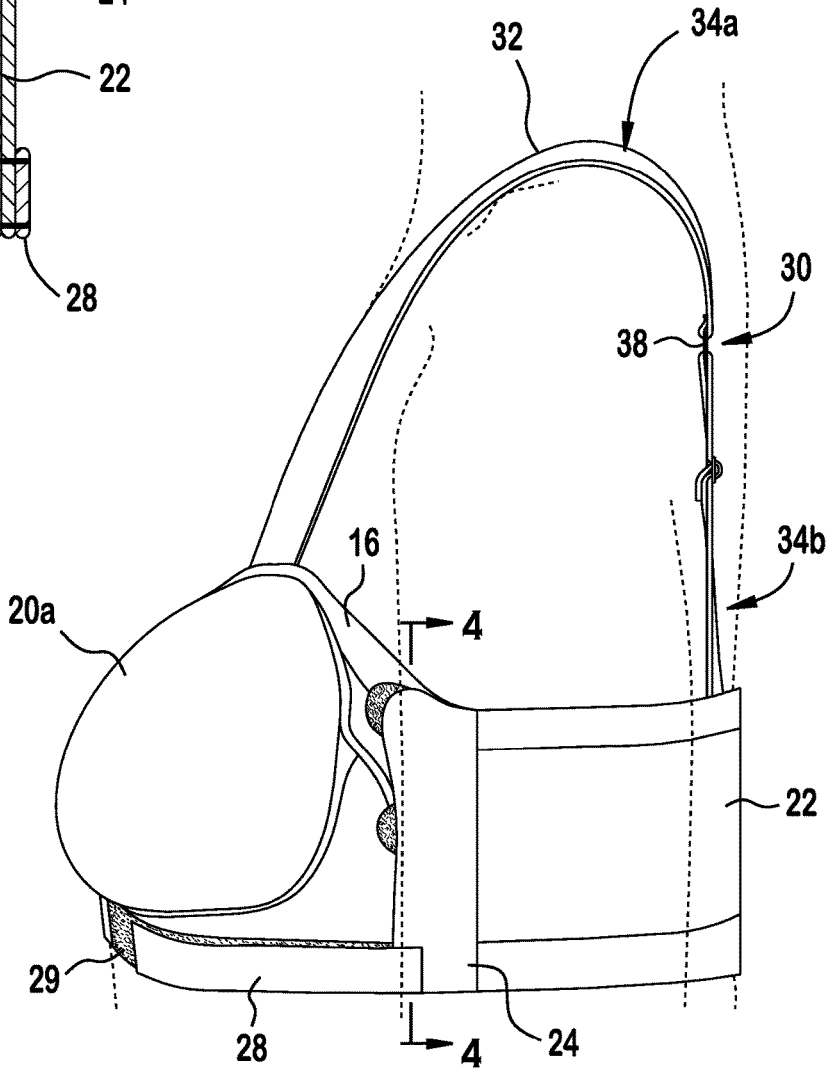
FIG. 3 is a left side elevational view of the brassiere 10 of FIG. 1, which demonstrates the placement of the free end 24 of the back panel 22 when the brassiere 10 is worn by the person 12. The free end 24 is placed over the first lateral end 18*a* of the cup support panel 16 and affixed thereto through the use of hook-and-loop material 29 or other fastening means. The pull strap 28 is preferably configured such that the entire length of the pull strap 28 may be detachably connected along an underside of the first breast cup 20*a* when the brassiere is worn. Such a configuration ensures that the entire length of the pull strap 28 may be held against the cup support panel 16, and that no portion hangs free. The figure demonstrates that the brassiere 10 fastens along the side of the person 12, with the side being a portion of the torso forward of the shoulder blade 14*a* or 14*b*.

Referring to FIGS. 1, 2 and 5, the brassiere 10 preferably also includes a shoulder support 30 configurable into a Y-shape, that is to say the shoulder support 30 preferably includes a longer arm and two shorter arms, with the two shorter arms forming an angle less than 90 degrees, and the three arms meeting a single location. The longer arm may be called a transverse arm 32, and is preferably connected to only one of the first and second breast cups 20*a* and 20*b*. In some preferred embodiments, it is preferred that the transverse arm 32 is permanently connected to either one of the first and second breast cups 20*b*, corresponding to the wearer's non-injured arm or affected body part. In other preferred embodiments, it is preferred that the transverse arm 32 be detachably connected to either one of the first and second breast cups 20*a-b*, and that the wearer can switch which of the breast cups 20*a-b* that the transverse arm 32 is connected to at will. It is preferred that the transverse arm 32 is detachably securable to the breast cups 20*a-b* through the use of loops and S-hooks. However, those of ordinary skill in the art will appreciate from this disclosure that any suitable means for this connection, such as hook-and-loop material, buttons, snaps, adhesive, or any other suitable connective means may be used without exceeding the scope of this disclosure.

The shorter arms may be called a first splayed arm 36*a* and second splayed arm 361), respectively. Each of the first and second splayed arm 36*a-b* are preferably connected to the back panel 22. It is preferred that the first and second splayed arms 36*a-b* be connected to the back panel 22 at locations that are aligned generally behind respective first and second breast cups 20*a-b* when the brassiere 10 is worn. In some embodiments, the first and second splayed arms 36*a-b* may be permanently affixed to the back panel 22. In other embodiments, the locations on the back panel 22 to which the first and second splayed arms 36*a-b* connect may adjustable. This may include embodiments in which the first and second splayed arms 36*a-b* are positionable along any two points of the back panel 22, or the first and second splayed arms 36*a-b* may be connected to the back panel at two of a set plurality of locations. In such embodiments, it is preferred that the first and second splayed arms 36*a-b* be detachably securable to the back panel 22 through the use of loops and S-hooks. However, those of ordinary skill in the art will appreciate from this disclosure that any suitable means for this connection, such as hook-and-loop material, buttons, snaps, adhesive, or any other suitable connective means may be used without exceeding the scope of this disclosure.

Figure 6:
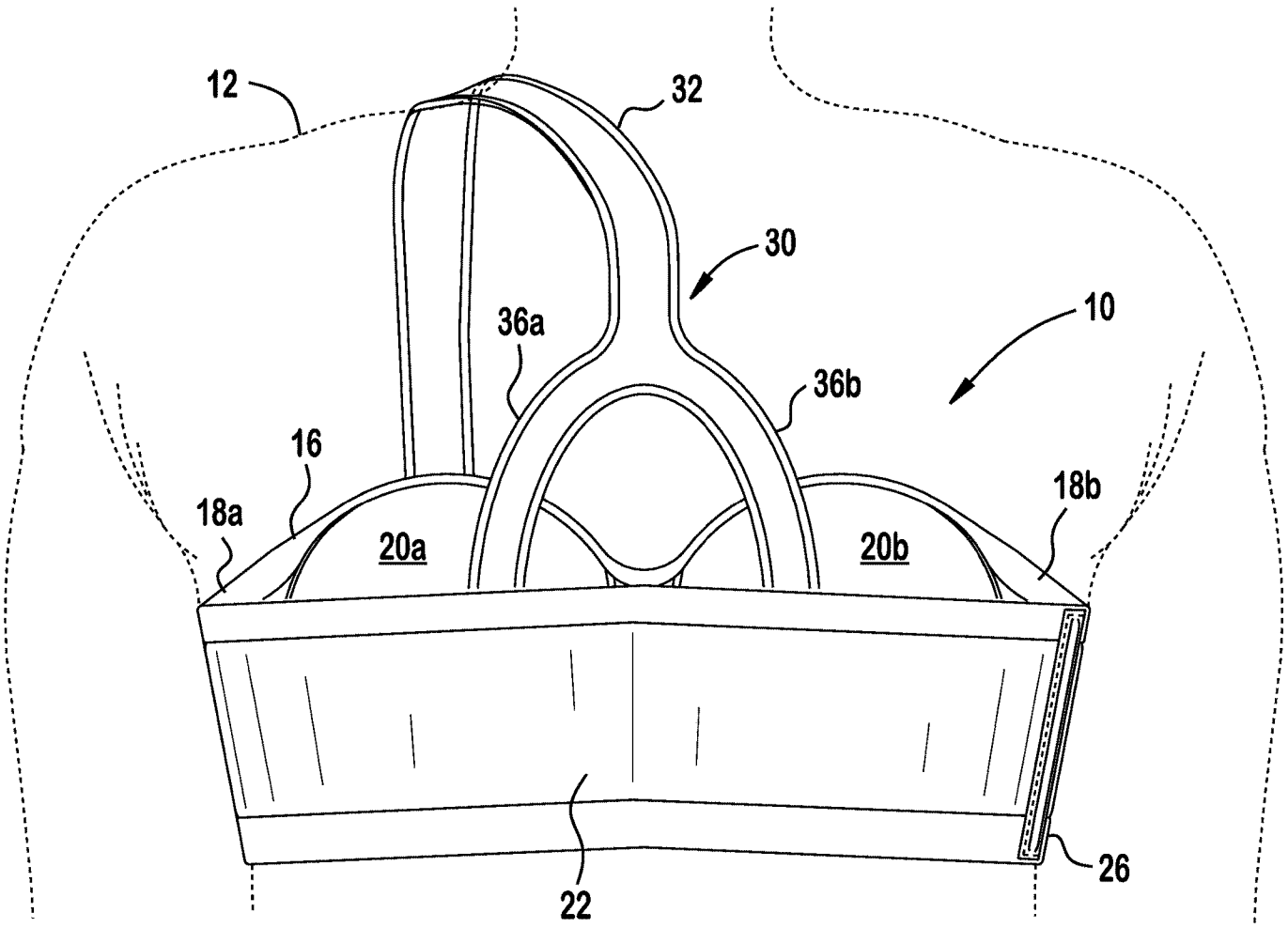
FIG. 6 is rear side elevational view of a second preferred embodiment of the brassiere 10, which demonstrates that the shoulder support 30 may be a single member defining a transverse arm 32, a first splayed arm 36*a*, and a second splayed arm 36*b*. Such an embodiment may be preferable for sports brassieres and for use under certain types of clothing, including dresses and racerback tanks.

Referring to FIG. 6, in one preferred embodiment, the shoulder support 30 may be formed of a single member defining the transverse arm 32 and first and second splayed arms 36*a-b*.

Referring again to FIGS. 1, 2, and 5, in another preferred embodiment, the shoulder support 30 may be formed of a first elongated member 34*a*, forming the transverse arm 32, and second elongated member 34*b*, forming the first and second splayed arms 36*a-b*. The first elongated member 34*a* may also form a junction 38 at an end opposite from the cup support panel 16, with the first and second splayed arms 36*a-b* meeting at the junction 38. In some preferred embodiments, the junction 38 may be positionally fixed, such that it can only be positioned at one location on the second elongated member 34*b*. Through such a configuration, the junction 38 may not be adjustable on the first and second splayed arms 36*a-b*. In other preferred embodiments, the junction 38 may be adjustably secured to the second elongated member 34*b*, with the junction 38 defining which portions of the second elongate member 34*b* form the first and second splayed arms 36*a-b*. In such embodiments, the junction may be formed of a loop, S-hook, or other suitable structure which may allow it to slide along the second elongate member 34*b* to change the angle and length of the first and second splayed arms 36*a-b* in relation to each other. For example, the junction 38 may be may be slid along the first splayed arm 36*a*, shortening the first splayed arm 36*a* and lengthening the second splayed arm 36*b*.

In some preferred embodiments, an adjustment mechanism 40 may be included on the shoulder support 30. In some preferred embodiments, the adjustment mechanism 40 may be included on the second elongated member 34*b* such that a second elongated member length (that is to say, a total length of the second elongated member 34*b* when measured from end to end) may be adjustable. In other preferred embodiments, the adjustment mechanism 40 may be included on the first elongated member 34*a* such that a first elongated member length (that is to say, a total length of the first elongated member 34*a* when measured from end to end) may be adjustable. And in still other preferred embodiments, adjustment mechanisms 40 may be included on both the first and second elongated members 34*a-b*, such that both the first elongated member length and second elongated member length may be adjusted. It is preferred that the adjustment mechanism 40 is formed of brassiere slides, which would allow the elongated member to be doubled over, decreasing or increasing the length of the elongated member without leaving excess slack trailing. However, those of ordinary skill in the art will appreciate from this disclosure that any suitable means for adjusting the length of the first and/or second elongated members 34*a-b* may be used without exceeding the scope of this disclosure.

In alternative embodiments, the first splayed arm 36*a* and second splayed arm 36*b* may be formed of separate elongated members, the second elongated member 34*b* and a third elongated member. In such embodiments, it is preferred that the all elongate members meet at the junction 38, and that some or all of the elongated members include the adjustment mechanism 40, to provide a brassiere 10 that is customizable to the wearer.

As to the preferred construction of the brassiere 10, it is preferred that the cup support panel 16 and back panel 22 be formed of lightweight materials which have a degree of flexibility, to provide greater support. Thus, preferred materials for forming the cup support panel 16 and back panel 22 include cotton, polyester or other synthetic fibers, elastic, or some combination thereof. It is preferred that the first and second breast cups 20*a-b* are formed of a material which might cushion the breasts and provide a desired shape. Preferred materials for forming the breast cups may include various kinds of foam, cotton, and other suitable materials. It is preferred that the shoulder support 30 and/or the first and second elongated members 34*a-b* are formed of durable material which may provide a degree of flexibility. Preferred materials for forming the shoulder support 30 and/or the first and second elongated members 34*a-b* include elastic, rubber, synthetic materials, or any combination thereof. It is preferred that any S-hooks, brassiere slides, or hoops may be formed of strong, rigid materials such as metal or plastic. Those of ordinary skill in the art will appreciate from this disclosure that the materials listed above are only preferred, and that any suitable materials and combinations thereof may be form the brassiere 10 and its various elements without exceeding the scope of this disclosure.

Referring to FIGS. 1-8, one preferred embodiment of the present invention operates as follows. A person 12 lifts the brassiere 10 places the shoulder support 30 over the person's shoulder. The person 12 may then align the brassiere 10 over the person's breasts, such that the first breast cup 20*a* covers the person's left breast and the second breast cup 20*b* covers the person's right breast. The person 12 then reaches the person's left arm behind his or her back and grasps the pull strap 28, pulling the back panel 22 left. The person 12 may then straighten the back panel 22 until it is in a suitable position, before pressing the free end 24 of the back panel 22 to the first lateral end 18*a* of the cup support panel 16 to cause the hook-and-loop material 29 to fasten. The pull strap 28 may then be pressed along the underside of the first breast cup 20*a*, fastening it thereto via the hook-and-loop material 29. The brassiere 10 may then be fully fastened along the person's side, being the portion of the torso in front of the first shoulder blade 14*a*. The person 12 may then adjust the position of the shoulder support 30, including the transverse arm 32 and first and second splayed arms 36*a-b*, along the person's back until the brassiere 10 is most comfortable. In some embodiments, the person may slide the junction 38 along the second elongated member 34*b*, into a preferred configuration.

In an alternative preferred embodiment of the present invention, the present invention operates as follows. The person 12 may attach the first elongated member 34*a* to the selected one of the first or second breast cups 20*a-b*. The person 12 may then attach the second elongated member 34*b* to two selected points along the back panel 22. The person 12 may then adjust the length of the second elongated member 34*b* using the adjustment mechanism 40. The position of the junction 38 on the second elongated member 34*b* may then be slidably adjusted, thus changing the length of the first and second splayed arms 36*a-b*. The person 12 may then lift the brassiere 10 and place it over the person's good shoulder. The person 12 may then align the brassiere 10 over the person's breasts, such that the first breast cup 20*a* covers the person's left breast and the second breast cup 20*b* covers the person's right breast. The person 12 may then reach the person's good arm behind his or her back and grasp the pull strap 28. The person may then pull the back panel 22 cross the person's back toward the person's good arm. The person 12 may then straighten the back panel 22 until it is in a suitable position, before pressing the free end 24 of the back panel 22 to either of the first lateral end 18*a* or second lateral end 18*b* of the cup support panel 16, depending on which lateral end is adjacent to and/or overlapped by the panel end 26 of the back panel 22, to cause the hook-and-loop material 29 to fasten. The pull strap 28 may then be pressed against the cup support panel 16, fastening it thereto via the hook-and-loop material 29. The brassiere 10 may then be fully fastened along the person's side, being the portion of the torso in front of the first shoulder blade 14*a* or second shoulder blade 14*b*. The person 12 may then adjust the position of the shoulder support 30, including the transverse arm 32 and first and second splayed arms 36*a-b*, along the person's back until the brassiere 10 is most comfortable. In some embodiments, the person may slide the junction 38 along the second elongated member 34*b*, into a preferred configuration.

It is recognized by those skilled in the art that changes may be made to the above described methods and structures without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A brassiere configured for donning while using a single arm by a person, comprising:

a cup support panel having first and second lateral ends and first and second breast cups thereon;

a back panel having a panel end and a free end, the panel end being at least one of adjacent to and overlapping with the second lateral end of the cup support panel, the free end of the back panel being detachably securable to the first lateral end of the cup support panel, wherein the back panel and the cup support panel are configured such that when the person is fully dressed in the brassiere the first lateral end of the cup support panel and the free end of the back panel are aligned on a side of the person forward of a shoulder blade of the person;

a shoulder support configurable into a Y-shape and having first and second splayed arms and a transverse arm, the transverse arm being connected to only one of the first and second breast cups; and wherein the first and second splayed arms of the shoulder support are connected to the back panel.

2. The brassiere of claim 1, wherein the shoulder support comprises a first elongated member, the first elongated member forming the transverse arm and forming a junction at an end opposite from the cup support panel, the first and second splayed arms meeting at the junction.

3. The brassiere of claim 2, wherein the junction of the first elongated member is positionally fixed and not adjustable on the first and second splayed arms.

4. The brassiere of claim 2, wherein the first and second splayed arms are formed by a second elongated member along which the junction is adjustably secured, the junction defining portions of the second elongated member that form the first and second splayed arms.

5. The brassiere of claim 4, wherein a second elongated member length of the second elongated member is adjustable.

6. The brassiere of claim 5, wherein the free end of the back panel is secured to the cup support panel via hook-and-loop material.

7. The brassiere of claim 5, wherein the first and second splayed arms are connected to the back panel at locations that are aligned behind the first and second cups when the brassiere is worn.

8. The brassiere of claim 7, wherein the transverse arm can be detachably connected to either one of the first and second breast cups.

9. The brassiere of claim 8, wherein a first elongated member length of the first elongated member is adjustable.

10. The brassiere of claim 5, wherein the front support panel further comprises channeling positioned along the first and second breast cups.

11. The brassiere of claim 10, further comprising boning positioned on the second lateral end of the cup support panel and providing additional support to the second breast cup.

12. The brassiere of claim 5, wherein the back panel is not adjustable in length.

13. The brassiere of claim 5, wherein a pull strap is positioned on the free end of the back panel.

14. The brassiere of claim 13, wherein an entire length of the pull strap is detachably connected along an underside of the first breast cup when the brassiere is worn such that the entire length of the pull strap lays directly over the cup support panel.

15. The brassiere of claim 14 wherein the back panel further comprises a side panel that forms the free end.

16. The brassiere of claim 11, further comprising boning positioned on the first lateral end of the cup support panel and providing additional support to the first breast cup.

17. The brassiere of claim 10, further comprising boning positioned on the first lateral end of the cup support panel and providing additional support to the first breast cup.

18. The brassiere of claim 10, wherein the channeling does not include underwire.

* * * * *